US005930873A

United States Patent [19]

Wyser

[11] Patent Number: 5,930,873

[45] Date of Patent: Aug. 3, 1999

[54] SYSTEM FOR ATTACHING A WRISTLET TO WATCH CASE

[75] Inventor: Paul Julian Wyser, Appenzell, Switzerland

[73] Assignee: Lascor S.p.A., Sesto Calende, Italy

[21] Appl. No.: 08/948,578

[22] Filed: Oct. 10, 1997

[30] Foreign Application Priority Data

Oct. 11, 1996 [IT] Italy ..... MI960678 U

[51] Int. Cl.[6] ..... A44C 5/18

[52] U.S. Cl. ..... 24/265 B; 24/265 WS; 224/178

[58] Field of Search ..... 224/178, 180, 224/164; 24/265 WS, 265 B, 265 R; 368/282; 59/79.1

[56] References Cited

U.S. PATENT DOCUMENTS

| | | | |
|---|---|---|---|
| 3,578,208 | 5/1971 | Herzog . | |
| 3,889,323 | 6/1975 | Reith | 24/265 B |
| 4,023,243 | 5/1977 | Vargas | 24/265 B |
| 4,183,986 | 1/1980 | Blatterlein . | |
| 4,513,896 | 4/1985 | Hirsch | 24/265 WS X |
| 5,630,329 | 5/1997 | Lauffer et al. | 63/5.1 |
| 5,657,515 | 8/1997 | Bert | 24/265 WS X |

FOREIGN PATENT DOCUMENTS 381 845 12/1986 Austria .

*Primary Examiner*—James R. Brittain
*Attorney, Agent, or Firm*—Griffin, Butler, Whisenhunt & Szipl, LLP

[57] ABSTRACT

A system for attaching a wristlet to a watch case (15) comprises at least one pin (45), which is situated in a cylindrical housing (45A) of a flexible resilient film (30), made of a plastic material or rubber, and at least one link (25) for attaching the wristlet to the watch case.

The connection between the watch case and the wristlet is achieved as a result of the presence of the film (30) which is inserted in openings, provided within the attaching link (25) and the other links of the wristlet.

The cylindrical housing (45A) comprises a series of hollow extensions (48), communicating with said housing, so that the coupling of a plastic element, such as the film (30), with the attaching link (25) made of metal has the effect of increasing the traction resistance of the wristlet with respect to the prior art.

10 Claims, 3 Drawing Sheets

SYSTEM FOR ATTACHING A WRISTLET TO WATCH CASE

The present invention relates to a system for attaching a wristlet to a watch case.

BACKGROUND OF THE INVENTION

There currently exist several solutions for fixing a wristlet to a watch case.

First, attaching systems achieved by means of melting the watch case with the attaching link in a single piece are known; however, in such case, the production costs are extremely high, since moulds which provide a suitable shape, for example comprising extensions protruding from the perimeter of the case, suitable for fixing the wristlet, are necessary.

There also exist attaching systems for plastic or leather straps and for metal wristlets comprising, usually, two pins, situated on diametrically opposite parts of the watch case, within housings, which are machined directly on the case or externally on the perimeter.

The strap (or wristlet) comprises a passage wherein the pin for fixing such strap or wristlet to the case is inserted.

In all the cases described, however, the wristlet comprises a link for attaching it to the watch case, which has a housing wherein the fixing pin slides.

It is therefore clear that the relative friction between two metal materials, of which the wristlet and the fixing pin are made, induces considerable mechanical fatigue and stress, especially when the watch is put on the user's wrist and when the wristlet is assembled or when components thereof are changed.

SUMMARY OF THE INVENTION

An object of the present invention is thus to provide a system for attaching a wristlet to watch cases, which obviates the aforementioned drawbacks; i.e. to provide a attaching system which is particularly robust and, at the same time, flexible, so that the wristlet adjusts to the shape of the user's wrist and is resistant to shocks and bending due to frequent use.

A further object of the present invention is to provide the attaching system in a simple and economical manner, without the need to use complex or costly technology.

Such aims are achieved by a system for attaching a wristlet to a watch case, said wristlet being formed by a plurality of links flanking each other and connected to each other, comprising at least one pin for attaching the watch case to the wristlet and at least one attaching link of said wristlet, which is fixed to said pin. Inside said links of the wristlet, at least one film made of resilient material is inserted, which has at least one housing, situated at one of its ends, suitable for housing said pin, at least one cut being made on the lateral surface of said housing, said cut defining at least one hollow in said film and communicating with said housing, so that at least a portion of lateral surface of the pin is not joined with the internal walls of said housing.

The wristlet may comprise advantageously a series of links flanking each other, which are hollow inside in order to allow the insertion of a resilient film, which allows, on the one hand, connection between two immediately adjacent links and considerable flexibility of movement of the links and, on the other hand, connection of the two immediately adjacent links to the watch case with two pins provided in suitable diametrically opposite housings of the case.

In a preferred but non limiting embodiment, the attaching links of the wristlet have a pliers-shaped end part, so that the resilient film, which ends in a substantially circular zone having a central housing of cylindrical shape where the pin for connection to the watch case is housed, may be housed within such links.

In an alternative embodiment, said housing has, according to one characteristic, along its circumference, at least one elongated extension in the direction parallel to the plane on which the watch case lies, in order further to increase the flexibility and capacity for deformation of the wristlet in the zones which are in contact with the case.

The features of the invention will become clearer from the description which follows and from the annexed drawings, relating to embodiments given by way of illustrative, but not limiting examples.

DESCRIPTION OF PREFERRED EMBODIMENTS

Figure 5:
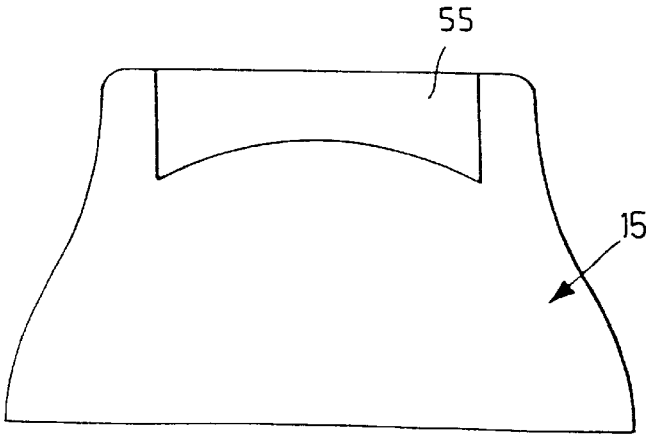
FIG. 5 shows a plane view of a second non limiting embodiment of a link for attaching a wristlet to a watch case, according to the present invention.

Referring to the aforementioned figures, the links of which the wristlet is composed are designated 20, the links for attaching the wristlet to watch case 15 are designated 25, three elements protruding from attaching link 25, which are used for connection with pin 45 of case 15, are designated 25A, 25B, 25C, while a single element connecting attaching link 25 to pin 45 of case 15 is designated 55 in FIG. 5.

A profile portion, which is partially concave with respect to the geometrical structure of attaching link 25, of one of the lateral surfaces of said attaching link 25 is designated 80, while a profile portion which is partially concave, again with respect to the geometrical structure of link 25, of another lateral surface of said attaching link 25 is designated 90.

A film or band made of plastic material or rubber, which is positioned inside wristlet 10, in openings 40 of links 20, 25 is designated 30. Finally, a housing of cylindrical shape made inside film 30, wherein pin 45 is inserted, is designated 45A and a hollow extension of said housing 45A is designated 48.

Figure 1:
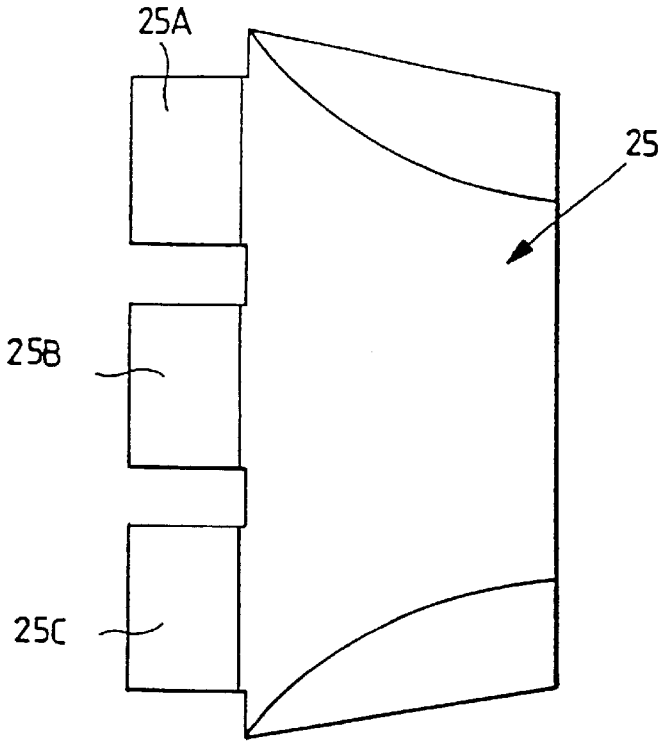
FIG. 1 shows a plane view of a first non-limiting embodiment of a link for attaching a wristlet to a watch case, according to the present invention.
Figure 3:
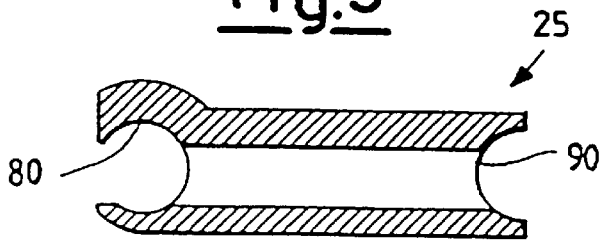
FIG. 3 is a cross-section of the attaching link of FIG. 2, along the line III—III.
Figure 4:
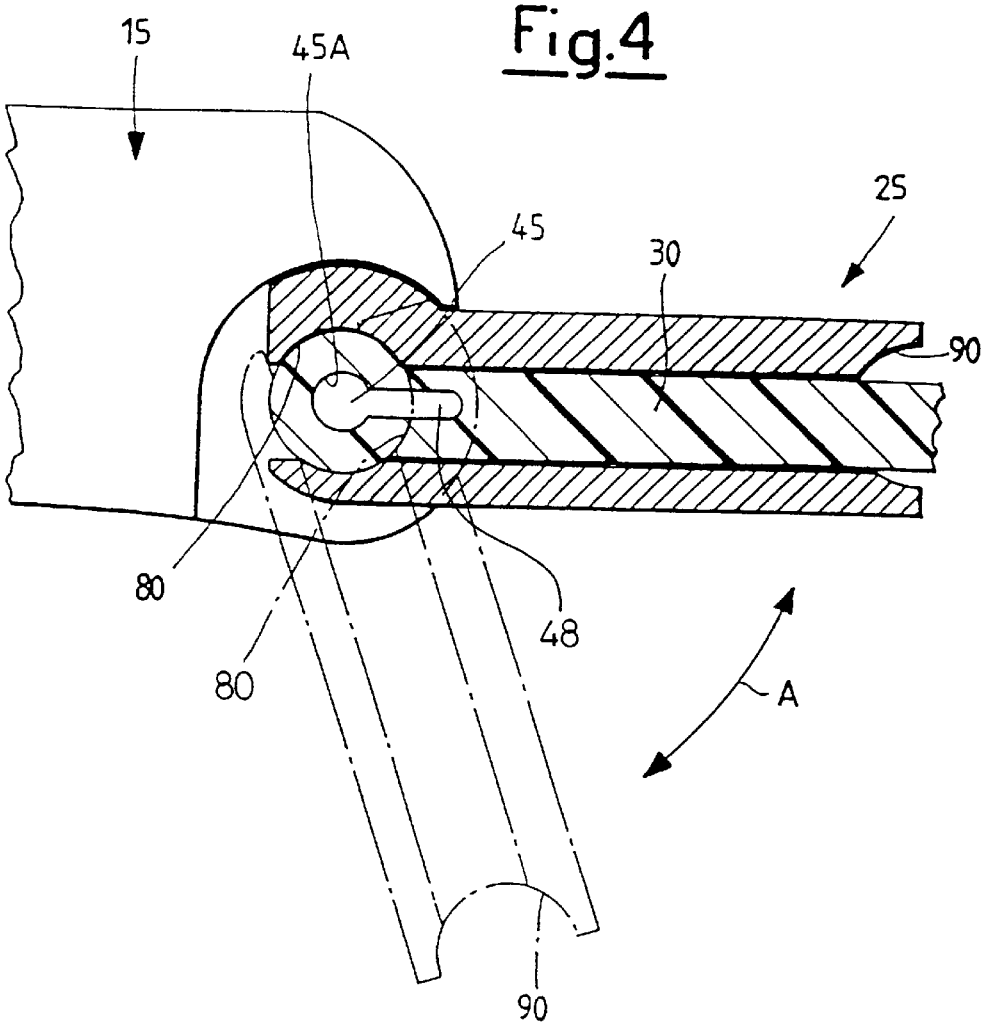
FIG. 4 is a partial side view (partially in cross-section) of system for attaching a wristlet to a watch case, according to the present invention; the end position of the attaching link with regard to the watch case when the link has been rotated about the pin being also shown in dot and dash lines.

In particular, in the case of the non limiting embodiment example illustrated in FIGS. 3 and 4, attaching link 25 has an external metal surface shaped like pliers, which partially contains a portion of film 30, of circular section, at the centre of which is provided a cylindrical housing 45A wherein pin 45 for connection to watch case 15 is housed.

Figure 7:
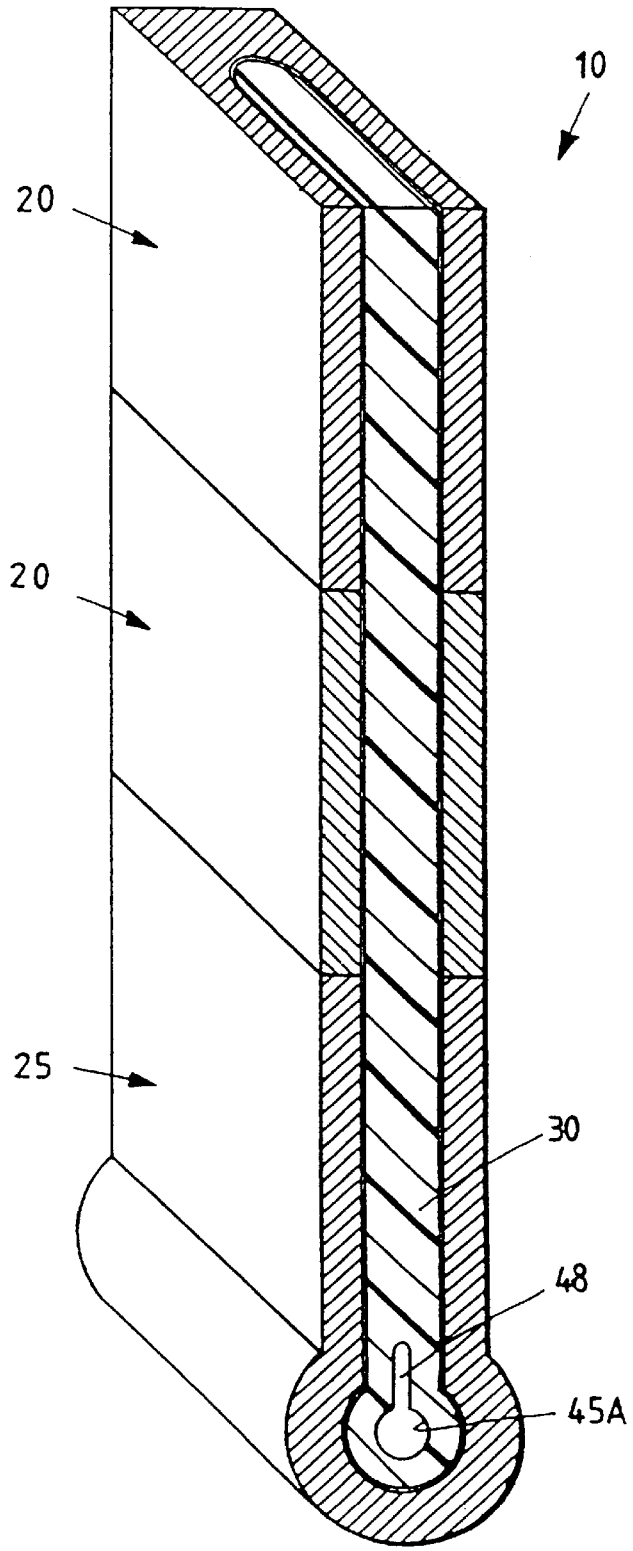
FIG. 6 and FIG. 7 are perspective partial and cross-section views of further embodiments of a system for attaching a wristlet to a watch case, according to the present invention.
Figure 6:
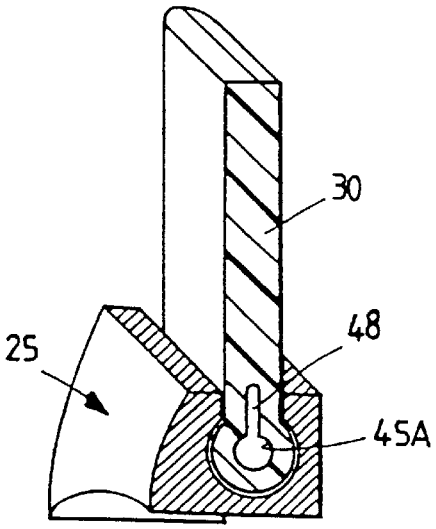

On the other hand, in the illustrative but non limiting case relating to FIGS. 5, 6 and 7, attaching link 25 has a geometrical profile which entirely encompasses film 30.

In this case also, said film 30 has an end portion of circular section, at the centre of which is made a cylindrical housing 45A which, in this case, has a hollow extension 48, used for the assembly of links 20, 25 and for the insertion of film 30 inside said links 20, 25, through opening 40.

Film 30, which is made of plastic material able to be deformed or rubber, is placed inside links 20, 25 using lateral openings 40 with which said links are provided and is fixed, via three protruding elements which adhere to elements 25A, 25B, 25C of attaching link 25, to a fixing pin 45 of watch case 15.

Figure 2:
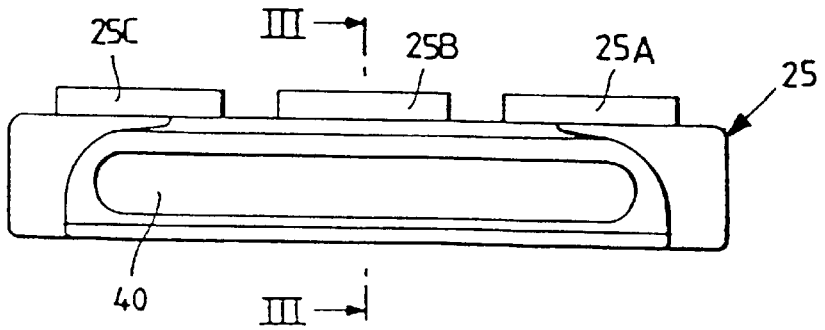
FIG. 2 shows a side view of the attaching link of FIG. 1.

It is to be noted, amongst other things, that in FIGS. 2 and 3, film 30, which, in reality, is inside attaching link 25, is not shown, purely for the sake of clarity of the drawings; naturally it must however be understood that, in the practical embodiment of the invention, said film 30 is situated immediately back to back with the internal walls of links 20, 25, within opening 40.

Moreover, links 20, 25 closely flanking each other, so that gaps between said links 20, 25 are not visible to an external observer and that there is no play or loose connections between the various parts.

Finally, the geometrical shape of each link 20 allows wide bending of wristlet 10 to be effected at the separations existing between one link 20 and the other and at the zones for attaching the wristlet to watch case 15.

In particular, the metal covering of attaching link 25 has a protective function as regards film 30, abutting in the vicinity of watch case 15.

In such manner, the entire structure has greater traction resistance, especially at the separations between links 20, 25 and at the interface between attaching link 25 and watch case 15, since the metal of link 25 protects the plastic of film 30 and releases within its own structure part of the traction force exerted.

Links 20 of wristlet 10 are substantially of parallelepiped shape and each has two openings 40 on two opposite lateral surfaces, so that a single hollow within wristlet 10 houses film 30.

Attaching link 25 also has lateral openings 40, which allow the insertion of film 30 and the fixing of the latter to pin 45, which is housed within cylindrical housing 45A of film 30.

In the illustrative embodiment example of FIGS. 3 and 4, the lateral surfaces of attaching link 25 have, seen in cross-section, partially complementary geometrical profiles; in fact, if a cross-section of a link 25 is made along a median plane perpendicular to the bases, one of the two surfaces has a portion 80 which is partially concave with respect to the geometrical structure of link 25 and in the shape of pliers, in order to assure the housing of film 30, into which, within cylindrical housing 45A, attaching hinge pin 45 slides, while the other surface has a profile 90 which is partially concave with respect to the geometrical structure of link 25 and can receive a partially convex portion (not shown) of the next link 20.

Moreover, one or more cuts are made at constant distance values in film 30 along cylindrical housing 45A wherein hinge pin 45 slides, actually constituting hollow extensions 48, arranged along the lateral surface of housing 45A, with which they communicate, and used for the purposes of mounting links 20, 25 around film 30.

It is to be noted that in FIGS. 6 and 7, where hollow extensions 48 are clearly visible, pin 45 (which is in reality, within cylindrical housing 45A) is not shown for the sake of clarity of the drawings.

The particular configuration of housing 45A allows a wide angular rotation (from 0 to approximately 150–160 degrees) of wristlet 10 about attaching pin 45, from a horizontal position with respect to the plane in which watch case 15 lies, according to a direction which is indicated schematically by arrow A in FIG. 4.

The features of the system for attaching a wristlet to watch cases, which is the subject of the present invention, are clear from the description given, as are its advantages.

In particular, these are represented by:

flexibility and adjustment of the wristlet to any shape of wrist of the user;

greater resilience and capacity for deformation with respect to the prior art;

use of a smaller number of components in the realisation of the wristlet and the system for attaching the wristlet to the watch case, since neither pins nor hinges are used between one link and another;

fewer drawbacks owing to wear due to friction of metal on metal or due to breaking of pins or hinges, during assembly of the wristlet;

greater traction resistance of the wristlet, with respect to known solutions, since the metal of the wristlet protects the internal plastic film and releases part of the traction;

lower production and assembly costs, with respect to the prior art.

Finally, it is possible to make modifications to the embodiments of the invention illustrated here, without departing from the principles which are at the basis of the innovative idea, as it is also possible that, in the implementation of the invention, the materials and dimensions could be selected according to technical requirements.

What is claimed is:

1. A wristlet comprising a system for attaching said wristlet to a watch case, said wristlet being formed by a plurality of links flanking each other and connected to each other, said attaching system comprising at least one pin for attaching the watch case to the wristlet and at least one attaching link of said wristlet, which is fixed to said pin, wherein, inside said plurality of links of the wristlet, a film made of resilient material is inserted, said film having in at least one of its ends a cylindrical housing, suitable for housing said pin, and at least one cut made on a lateral surface of said housing, said cut forming a hollow extension of said housing within said film and communicating with said housing, so that a portion of lateral surface of said pin is not joined with internal walls of said housing in the region of said hollow extension.

2. The wristlet of claim 1, wherein said film is made of plastic material or rubber.

3. The wristlet of claim 1, wherein each of said links of the wristlet has a substantially parallelepiped shape, is hollowed, and has at least two openings, provided on at least two opposite lateral surfaces.

4. The wristlet of claim 3, wherein one of said opposite lateral surfaces has a partially concave geometrical profile, with respect to the geometrical structure of said link, while the other surface has a partially convex geometrical profile, again with respect to the geometrical structure of said link.

5. The wristlet of claim 1, wherein said attaching link comprises a single element for connection to the watch case.

6. The wristlet of claim 1, wherein said attaching link comprises three elements for connection to the watch case.

7. The wristlet of claim 1, wherein an angular rotation of said attaching link about said fixing pin can be made from a horizontal position of said attaching link, with respect to a plane which is defined by the watch case, to an angle which is within the range of 0 to 150 degrees.

8. The wristlet of claim 1, wherein said cut extends into said film away from the watch case.

9. A wristlet comprising a system for attaching said wristlet to a watch case, said wristlet being formed by a plurality of links flanking each other and connected to each other, each of said links of the wristlet having a substantially parallelepiped shape, being hollowed, and having at least two openings, provided on at least two opposite lateral surfaces, one of said opposite lateral surfaces has a partially concave geometrical profile, while the other surface has a partially convex geometrical profile, said attaching system comprising at least one pin for attaching the watch case to the wristlet and at least one attaching link of said wristlet, which is fixed to said pin, wherein, inside said plurality of links of the wristlet, a film made of resilient material is inserted, said film having in at least one of its ends a cylindrical housing, suitable for housing said pin, and at least one cut made on a lateral surface of said housing, said cut forming a hollow extension of said housing within said film and communicating with said housing, so that a portion of lateral surface of said pin is not joined with internal walls of said housing in the region of said hollow extension.

10. A system for attaching a wristlet to a watch case, said system comprising:

a hinge pin adapted to be engaged into the watch case;

a hollow attaching link of the wristlet, having a pliers-shaped end portion facing the watch case, said end portion having a concave profile;

a film of resilient material inserted through said attaching link and having a head portion received in said concave profile, said attaching link encompassing said films;

wherein said film has a cavity comprising a housing, arranged in said head portion for receiving said hinge pin, and a hollow extension communicating with said housing and extending into said film away from the watch case.

* * * * *